235-379 SR
8/14/84 OR 4,465,925

United States Patent [19]

Goi

[11] Patent Number: 4,465,925

[45] Date of Patent: Aug. 14, 1984

[54] AUTOMATIC MONEY DEPOSITING AND DISBURSING MACHINE

[75] Inventor: Kowichi Goi, Tokyo, Japan

[73] Assignee: Laurel Bank Machine Co., Ltd., Tokyo, Japan

[21] Appl. No.: 376,035

[22] Filed: May 7, 1982

[30] Foreign Application Priority Data

| | | | |
|---|---|---|---|
| May 9, 1981 | [JP] | Japan | 56-69811 |
| May 22, 1981 | [JP] | Japan | 56-77548 |
| Jun. 25, 1981 | [JP] | Japan | 56-98785 |

[51] Int. Cl.[3] ..... G07D 7/00

[52] U.S. Cl. ..... 235/379; 194/DIG. 26; 209/534

[58] Field of Search ..... 235/377, 380, 381, 382; 209/534; 109/19; 232/4 R, 5, 6, 44; 221/7, 13, 15, 79; 194/DIG. 26, DIG. 4, DIG. 6, DIG. 9

[56] References Cited

U.S. PATENT DOCUMENTS

| | | | |
|---|---|---|---|
| 3,447,655 | 6/1969 | Tanaka et al. | 194/4 |
| 3,826,344 | 7/1974 | Wahlberg | 194/2 |
| 4,253,016 | 2/1981 | Hirose | 235/381 |

FOREIGN PATENT DOCUMENTS

| | | | |
|---|---|---|---|
| 54-1697 | 1/1979 | Japan | 194/DIG. 26 |
| 56-33758 | 4/1981 | Japan | 235/379 |
| 56-50460 | 5/1981 | Japan | 235/379 |

*Primary Examiner*—Harold I. Pitts
*Assistant Examiner*—Robert Lev
*Attorney, Agent, or Firm*—Fleit, Jacobson, Cohn & Price

[57] ABSTRACT

An automatic money depositing and disbursing machine includes a common delivery passage used to deliver the deposited notes to a receiving box for deposit and deliver the notes to be paid to a disbursing port for disbursement. A discriminating section is disposed adjacent the common delivery passage for discriminating the notes.

4 Claims, 4 Drawing Figures

AUTOMATIC MONEY DEPOSITING AND DISBURSING MACHINE

BACKGROUND OF THE INVENTION

The present invention relates to an automatic money depositing and disbursing machine for permitting automatic deposit and disbursement of notes.

A depositing function and a disbursing function are required for an automatic money depositing and disbursing machine, and in the conventional machine, for example, the following operations shown in FIG. 1 are performed to satisfy this requirement. More specifically, in the depositing operation, notes inserted onto a receipt port as a group are separated and fed out one by one by a separating and delivering section, and forged notes or different kinds of notes are checked by a discriminating section. The notes judged as genuine notes are temporaily stored in a pool section and the notes judged as being different from genuine notes are returned to a return port. After completion of the discriminating operation, the amount of money is confirmed by a customer, and the notes stored in the pool section are fed to the return port or a receiving box arranged in the machine. In order to perform this deposit operation, there are disposed a delivery passage for delivering notes into the discriminating section, a delivery passage extending from the discriminating section to the return port, a delivery passage extending from the pool section to the return port and a delivery passage extending from the pool section to the receiving box.

In the disbursing operation, notes contained in a storage box arranged in the machine are separated and delivered one by one by the separating and delivering section, and they are temporarily stored in the pool section after checking incorporation of different kinds of notes or double feeding by the discriminating section. If a predetermined number of notes are stored in the pool section without detection of any disorder, the notes are fed to a disbursing port from the pool section. When a disorder is detected before a predetermined number of notes are stored in the pool section, the normal notes already stored and the checked abnormal note are fed to a reject box from the pool section. In order to perform this disbursing operation, there are disposed a delivery passage for delivering notes to the discriminating section, a delivery passage extended from the pool section to the disbursing section and a delivery passage extended from the pool section to the reject box.

Simultaneously with the disbursing operation, a receipt is issued from a receipt issuing section, temporarily stored in a receipt pool section, fed to the pool section from the receipt pool section and discharged together with the paid notes.

In the above-mentioned automatic money depositing and disbursing machine, however, an independent depositing machine and an independent disbursing machine are assembled in a machine frame to construct one automatic system and pluralities of discriminating sections, pool sections and delivery passages are arranged, with the result that the size of the machine is increased and the structure is complicated.

SUMMARY OF THE INVENTION

It is, therefore, an object of the present invention to provide an automatic money depositing and disbursing machine which is simple and compact in construction.

It is another object of the present invention to provide an automatic money depositing and disbursing machine of the above type in which a common delivery passage is provided for delivering deposited notes or notes to be paid while the notes are discriminated.

It is a further other object of the present invention to provide an automatic money depositing and disbursing machine of the above type in which a depositing box and a reject box are integrally made to form a receiving box and thereby allowing the machine to be compact.

In accordance with the present invention, there is provided a automatic money depositing and disbursing machine wherein deposited notes are stored and notes to be paid are disbursed, which comprises a common delivery passage for delivering deposited notes fed from a depositing section and notes to be paid fed from a storage box and a discriminating section disposed adjacent the common delivery passage for detecting the presence of forged notes, double feeding and incorporation of different kinds of notes.

DESCRIPTION OF THE DRAWINGS

The present invention will now be described in detail by reference to an embodiment illustrated in the accompanying drawings in which.

DESCRIPTION OF THE PREFERRED EMBODIMENT

One embodiment of the present invention will be now described in detail with reference to the accompanying drawings.

Figure 1:
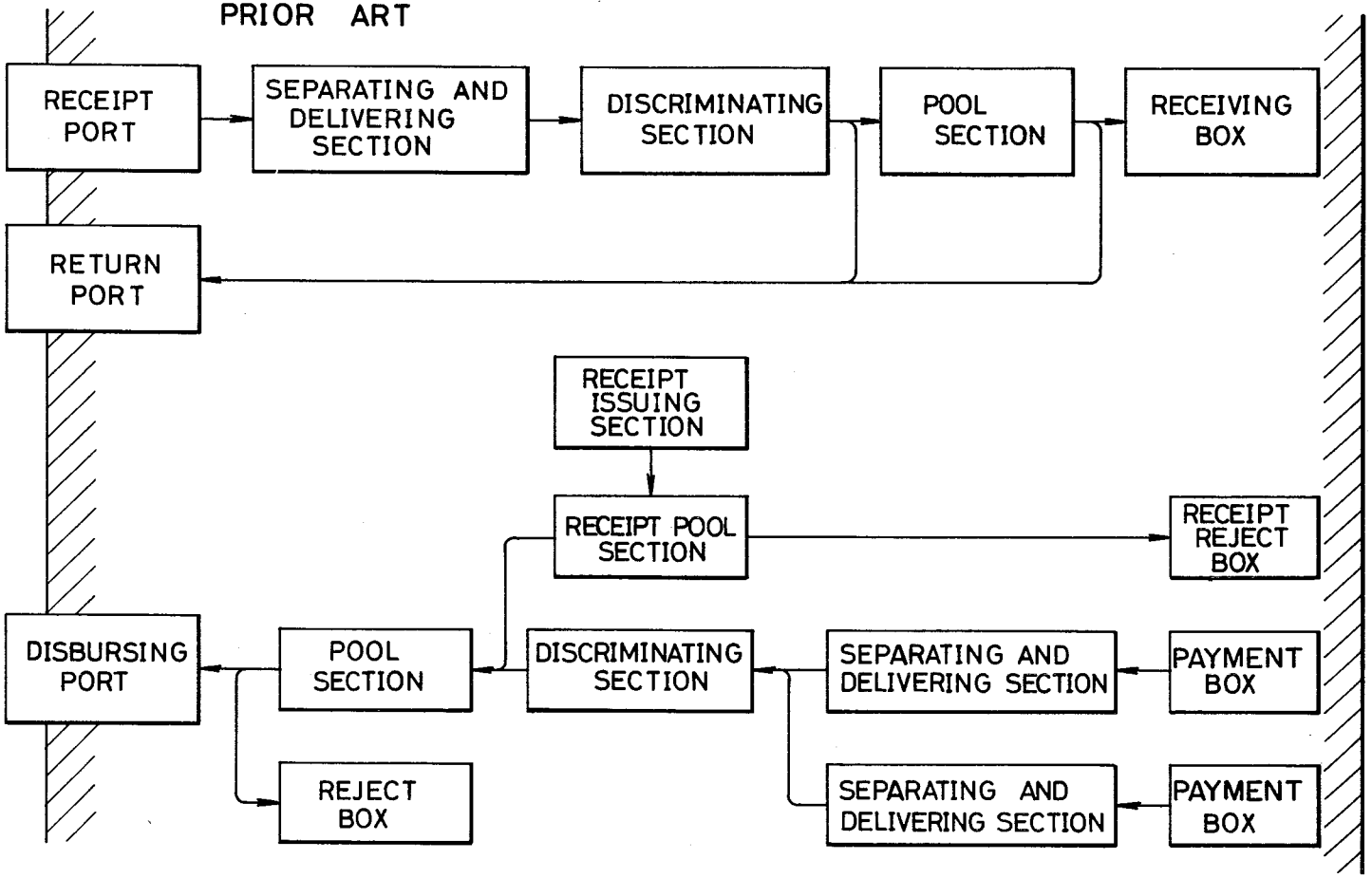
FIG. 1 PRIOR ART
FIG. 1 is a flow chart showing operations of the conventional automatic money depositing and disbursing machine.
Figure 2:
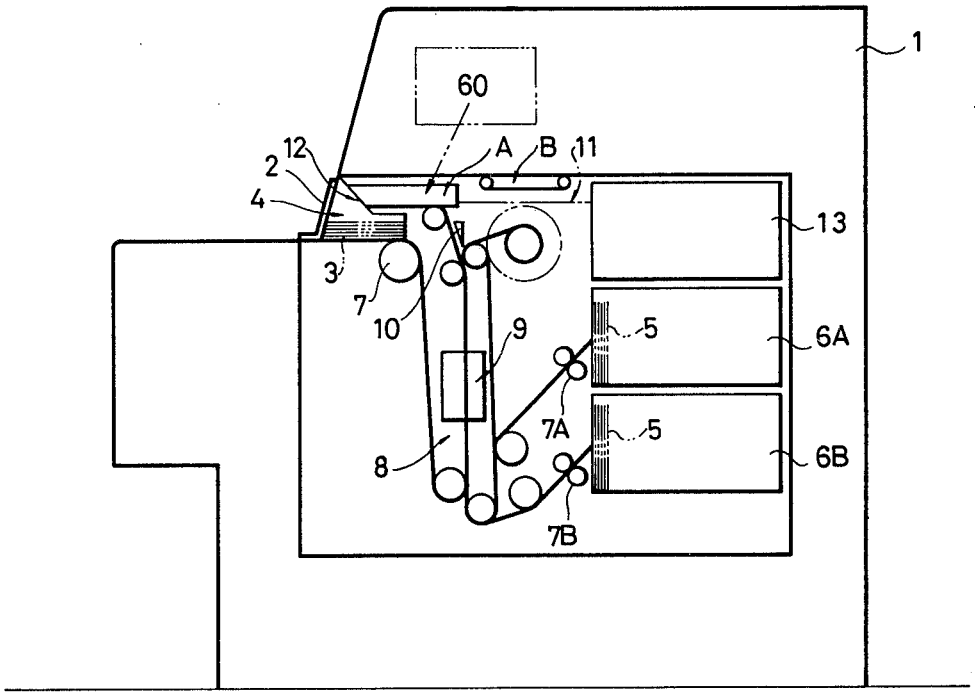
FIG. 2 is a diagrammatical side view showing the construction of an embodiment according to the present invention.

The structure of the automatic money depositing and disbursing machine of the present invention will now be oulined with reference to FIG. 2.

In the automatic money depositing and disbursing machine of the present invention, a dealing port 2 is opened on the front face of a machine proper 1, and a receiving section, for receiving deposited notes 3 is formed on the inner side of the dealing port 2. In the machine, there are arranged storage boxes 6A and 6B for storing notes 5 to be paid. The deposited notes 3 and notes 5 to be paid are fed one by one to a delivery passage 8 by separating and delivering sections 7, 7A and 7B and are checked in a discriminating section 9 to detect the presence of a forged note, double feeding, incorporation of a different kind of a note and abnormal length. A gate 10 operated by the discriminating section 9 is mounted on the exit of the delivery passage 8 and this gate 10 changes over the note delivery direction to a pool section 11 for temporarily storing notes or a delivery passage A for delivering notes to a disbursing section 12 located on the inner side of the dealing port 2. The notes in the pool section 11 are fed into said delivery passage A or a receiving box 13 through a delivery passage B.

The automatic money depositing and disbursing machine will now be described in detail with reference to FIG. 3.

The delivery passage 8 for delivering the deposited notes 3 and notes 5 to be paid is laid out among delivery belts for delivering the notes in the gripped state. The descriminating section 9 is provided at a location where the delivery belts 30 and 31 are in contact with each other. The gate 10 is arranged in close proximity to a belt roller 31*a* on the top end of the delivery belt 31, and the gate 10 is turned about a shaft 10*a* and thus moved to the position where the plane portion 10*b* lies along the delivery belt 32 or the curved portion 10*c* lies along the belt roller 31*a*.

A collecting wheel 40 for receiving notes delivered out from the delivery passage 8 is arranged in close proximity to the belt roller 31*a*, and this collecting wheel 40 is supported rotatably on a shaft 40*a* and is rotated in the state where notes are gripped between every two adjacent vanes 40*b* attached to the periphery of the collecting wheel 40. A plurality of vanes 40*b* are formed at predetermined intervals in the axial direction of the shaft 40*a* so that the end portions or both the end portions and the middle portions of notes are gripped. A feed belt 40*c* is wound on the belt roller 31*a* and the collecting wheel 40. As shown in FIG. 3, on both the sides of this collecting wheel 40, a bent frame 41 is supported rotatably about a shaft 41*a*, and belt rollers 42*a* on which a lower feed belt 42 for moving a note while having contact with the lower face thereof are attached to the top end portion of the frame 41. A scrape-down member 41*b* for scraping down notes gripped between the vanes 40*b* is formed in the intermediate bent portion of the bent frame 41. The lower feed belt 42 is driven by a feed roller 43 rotated about the shaft 41*a* through driving belts 42*b*. A lower delivery belt 44 is arranged in the rear of the feed roller 43 apart therefrom, and the receiving box 13 is arranged below the lower delivery belt 44. The receiving box 13 includes a reject box 13*a* arranged below between one end portion of the lower delivery belt 44 and the feed roller 43 to contain the abnormal ones of notes 5 therein and a depositing box 13*b* arranged below the other end portion of the lower delivery belt 44 to contain the deposited notes 3 therein. A lid 13*c* is swingably mounted on the upper portion of the depositing box 13*b* so that the lid 13*c* can freely be opened and closed. A lid 13*d* is slidably mounted on the upper portion of the reject box 13*a* so that the lid 13*d* can freely be opened and closed. A gate 45 is disposed between the feed roller 43 and the lower delivery belt 44 to change over the note delivery direction toward the reject box 13*a* or the depositing box 13*b*. This gate 45 is supported rotatably on a shaft 44*b* of one belt roller 44*a* of the lower delivery belt 44.

An upper feed belt 46 is arranged above the collecting wheel 40 and is wound on a belt roller 46*b* arranged to be rotatable about a shaft 46*a* through an arm (not shown), a belt roller 46*c* arranged rotatable about the shaft 46*a* through another arm (not shown) and a belt roller 46*d* turning together with the belt roller 46*b*, so that both the ends of the upper feed belt 46 are brought down under rotation to come in contact with the upper face of the note. The pool section 11 is formed between the upper feed roller 46 and the collecting wheel 40 to temporarily store notes therein. A belt roller (not shown) is supported coaxially with the belt roller 46*c*, and a lower delivery belt 47 is wound on this belt roller and the belt roller 47*a* above the lower delivery belt 44 so that the note is gripped between the lower delivery belt 44 and the upper delivery belt 47. A registration plate 48 is disposed below the upper feed belt 46 between the collecting wheel 40 and the feed roller 43 so that the registration plate 48 can turn about a shaft 48*a*. At the vertical posture, the registration plate 48 falls in contact with the top ends of the notes accumulated between the collecting wheel 40 and the upper feed belt 46. The delivery passage B shown in FIG. 2 is defined by the lower feed belt 42, the upper feed belt 46, the lower delivery belt 44 and the upper delivery belt 47.

A feed roller 50 is arranged in close proximity to the belt roller 32*a* on the top end of the delivery belt 32 so that the note is delivered in the state where the note is gripped between the delivery belt 32 and the feed roller 50. A guide plate 51 is rotatably supported on a shaft 50*a* of the feed roller 50 to guide in the horizontal direction the note fed out upward from the delivery belt 32. A belt roller (not shown) is rotatably supported coaxially with the belt roller 32*a*. A horizontal lower disbursing belt 52 running toward the disbursing zone 12 in the left portion of FIG. 3 is wound on this belt roller. An upper disbursing belt 53 for gripping the note between the lower disbursing belt 52 and the upper disbursing belt 53 and a pressing belt 54 are arranged above the lower disbursing belt 52, and the upper disbursing belt 51 is wound on belt rollers 53*b* and 53*c* supported by arms (not shown) rotatable about a shaft 53*a*. The pressing belt 54 is wound on a belt roller 54*b* supported by an arm (not shown) rotatable about a shaft 54*a* and the above-mentioned belt roller 53*b*. The delivery passage A shown in FIG. 2 is defined by the delivery belt 32, the feed roller 50, the lower disbursing belt 52, the upper disbursing belt 53 and the pressing belt 54. While the lower disbursing belt 52 is stopped, its front end portion constitutes a return pool section for temporarily storing deposited notes to be returned.

The operations of the automatic money depositing and disbursing machine having the above-mentioned structure will now be described with reference to FIGS. 2 through 4.

In the depositing operation, deposited notes 3 are put into the receiving section 4 from the dealing port 2, and they are separated one by one and fed into the delivery passage 8 by the separating and delivering section 7. While the notes 3 are delivered, discrimination for detection of forged notes and the like is effected by the discriminating section 9. When the deposited note 3 is judged as a genuine note, gate 10, which is located at a position indicated by the solid line in FIG. 3, the note 3 to be fed to the collecting wheel 40. The deposited note 3 held on the collecting wheel 40 is scraped down by the scrape-down member 41*b* of the frame 41 at the position indicated by the solid line in FIG. 3. The notes 3 thus scraped down are stocked on the pool section 11 above the collecting wheel 40 from the lower side of the pool section 11, and they are temporarily stored while they are arranged by the registration plate 48 having abutting contact with one end of the notes at the position indicated by the solid line in FIG. 3. When the deposited note 3 is judged as being different from a genuine note, the gate 10 is shifted to a position indicated by the two-dot chain line in FIG. 3 by a signal emitted from the discriminating section 9, and the deposited note 3 is fed between the delivery belt 32 and the feed roller 50 (delivery passage A) and further fed out onto the lower disbursing belt 52 (return pool section) which is stopped along the guide plate 51 in the state indicated by the solid line in FIG. 3. The note 3 is temporarily stored in this return pool section. After discrimination of all the deposited notes 3, the amount of money is confirmed by the customer (operator) in the state where notes judged as genuine notes are stored in the pool section 11 and notes judged as being different from genuine notes are stored in the return pool section. According to the result of the confirmation, the notes in the pool section 11 are delivered to the depositing box **13*b* or the disbursing section 12. This delivery operation is accomplished by rotating and elevating the frame 41 to raise up the lower feed belt 42 to the horizontal state indicated by the two-dot chain line in FIG. 3, rotating and bringing down the upper feed belt 46 to grip the notes in the pool section 11 between the upper feed belt 46 and the lower feed belt 42, and rotating the upper and lower feed belts 42 and 46 in this state in the normal direction or reverse direction. When the notes are fed to the disbursing section 12 and returned, the notes on the lower disbursing belt 52 are fed to the disbursing section 12. The guide plate 51 is then set in the horizontal state indicated by the two-dot chain line in FIG. 3, and the upper and lower feed belts 42 and 46 are driven to feed the notes onto the lower disbursing belt 52 and the notes are fed to the disbursing section 12. At this time, the upper disbursing belt 53 and the pressing belt 54 are turned and brought down according to the thickness of the notes to press the notes to the lower disbursing belt 52. When the notes are received in the depositing box 13*b*, the registration plate 48 is set at the horizontal position indicated by the two-dot chain line in FIG. 3 and the gate 45 is set at the horizontal position indicated by the solid line in FIG. 3. The notes are gripped between the upper and lower feed belts 42 and 46, fed to the right in FIG. 3 and are further delivered to the depositing box 13*b* by the lower delivery belt 44. At this time, the upper delivery belt 47 is turned and brought down according to the thickness of the notes to press the notes to the lower delivery belt 44. The lid 13*c* is opened as indicated by the solid line in FIG. 3 in the state where the receiving box 13 is attached to the machine proper 1**.

Figure 3:
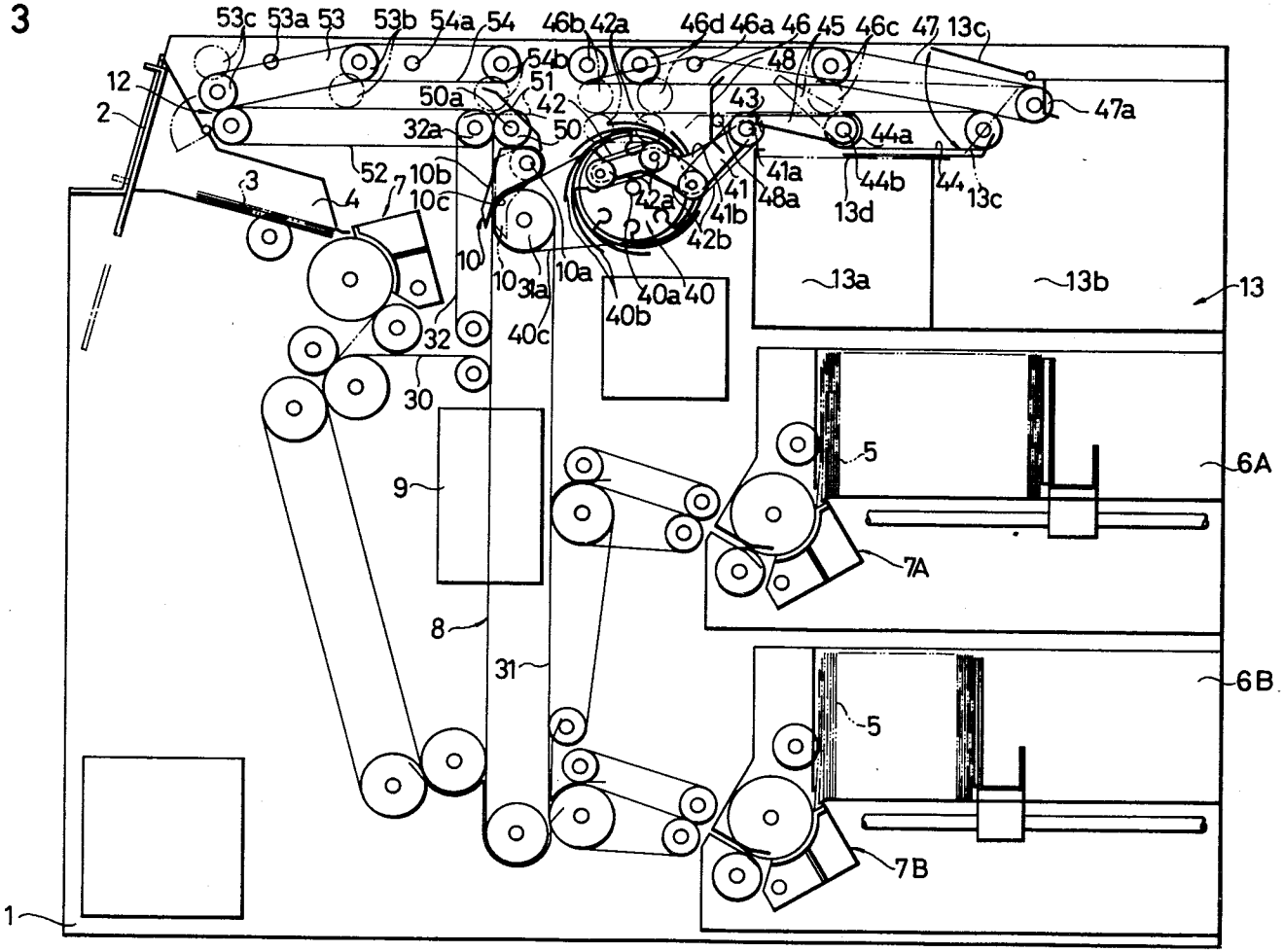
FIG. 3 is an enlarged side view showing the embodiment in detail.
Figure 4:
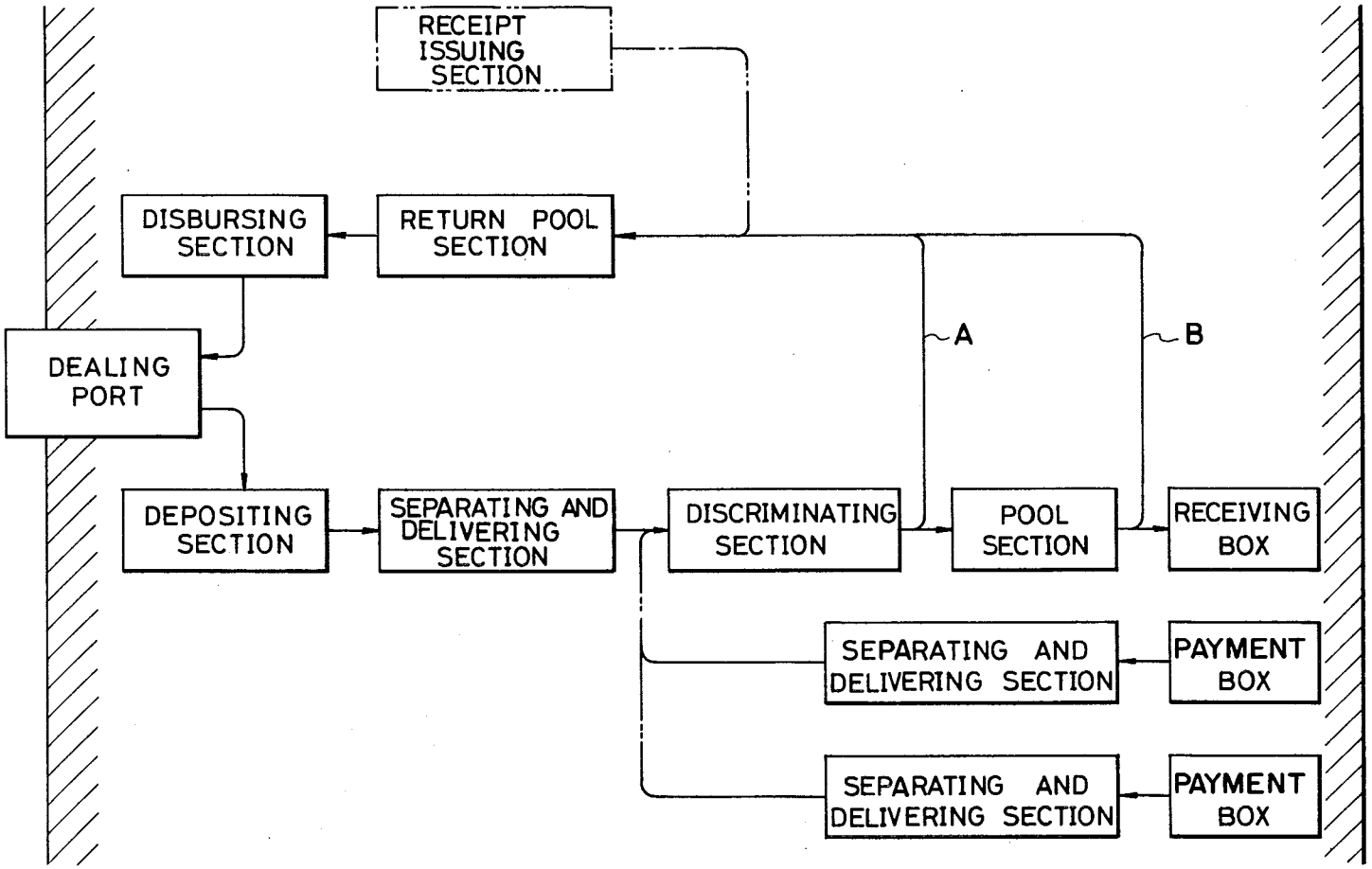
FIG. 4 is a flow chart showing operations of the automatic money depositing and disbursing machine according to the present invention.

After the deposited notes have thus been treated, the upper feed belt 46, upper disbursing belt 53 and pressing belts 54 are turned and elevated as indicated by the solid line in FIG. 3 and the frame 41 is turned and brought down as indicated by the solid line in FIG. 3. At that time the machine is ready for a subsequent depositing or disbursing operation.

At the disbursing operation, notes to be paid or discharged are separated and delivered one by one from payment boxes 6A and 6B to the delivery passage 8 by the separating and delivering sections 7A and 7B. While the notes are being delivered, discrimination is performed. Then, while the gate 10 is set at the position indicated by the solid line in FIG. 3, all the notes to be paid are fed into the collecting wheel 40. In case of the above-mentioned depositing operation, the notes are temporarily stored in the pool section 11. When notes in a number corresponding to the amount of money to be disbursed are stored in the pool zone 11 without detection of any disorder, the notes are fed onto the lower disbursing belt 52 located in the left portion of FIG. 3 while they are gripped between the upper and lower feed belts 42 and 46. The notes are delivered to the disbursing section 12 by the lower disbursing belt 52, upper disbursing belt 53 and pressing belt 54. If a disorder is detected before a predetermined number of notes are stored in the pool section 11, the separating and delivering zones 7A and 7B are stopped to stop delivery of the notes and the abnormal note is contained in the pool section 11. Then, all the notes in the pool section 11 are gripped by the upper and lower feed belts 42 and 46, and the gate 45 is opened as indicated by the two-dot chain line in FIG. 3 to feed the notes toward the right in FIG. 3 into the reject box **13*a***. Then, the above-mentioned disbursing operation is conducted from the start.

After the disbursing operation has been completed, the upper feed belt 46, upper disbursing belt 53 and pressing belt 54 are turned and elevated as indicated by the solid line in FIG. 3, and the frame 41 is turned and brought down as indicated by the solid line in FIG. 3 to set the gates 10 and 45 as indicated by the solid line in FIG. 3. At the time, the machine is ready for a subsequent depositing or disbursing operation.

When it is necessary to issue a receipt on disbursement, a receipt issuing section 60 is formed in the upper portion of the machine as shown in FIG. 2, and a receipt issued from the receipt issuing section 60 is fed out onto notes on the lower disbursing belt 52 (return pool section) and delivered to the disbursing section 12 together with the notes.

In the above-mentioned construction of the present invention, although the portion indicated at **13*a* within the receiving box 13 has been explained as the reject box and the portion 13*b* as the depositing box, the portion 13*a* may be made to be a depositing box and the portion 13*b*** may be made to be a reject box.

Furthermore, in case where the money check is made in a subsequent treatment, the receiving box 13 is removed out of the machine body 1 and the notes within the reject box **13*a* and the notes within the depositing box 13*b* are counted, respectively. At the time, the lids 13*c* and 13*d*** may be constructed to be locked so as to be closed by a locking mechanism, not shown.

Furthermore, in the above-mentioned discriminating section 9, a device for detecting a photo-pattern transparency, a device for detecting a photo-pattern reflection, a device for detecting a magnetic pattern, a device for optically detecting a double feeding, an abnormal length, an inclined feeding and an adjacent feeding, and a device for mechanically detecting an abnormal thickness may be provided.

In the case where depositing operations are made, all the devices may be used. However, in case where disbursing operations are made, only the latter two devices may be used.

What is claimed is:

1. An automatic money depositing and disbursing machine wherein deposited notes are stored and notes to be paid out are disbursed, said machine comprising:

a dealing port;

a receiving section in communication with the dealing port for receiving deposited notes;

at least one payment box for storing notes to be paid out;

a common delivery passage disposed downstream of and in communication with the receiving section and downstream of and in communication with the payment box for delivering deposited notes fed from the receiving section and delivering notes to be paid out from the payment box;

a discriminating section disposed adjacent the common delivery passage for discriminating the notes passing therethrough and detecting forged notes, double feeding, and different kinds of notes;

a pool section disposed downstream of and in communication with the common delivering passage for temporarily storing notes;

a second delivery passage disposed downstream of and in communication with the pool section for delivering the notes therefrom to a receiving box;

a disbursing section for delivering the notes to the dealing port;

a third delivery passage disposed downstream of and in communication with the common delivery passage for delivering notes therefrom to the disbursing section; and switching means disposed downstream of the common delivery passage for switching the notes from the common delivery passage into either one of the pool section and the third delivery passage.

2. A machine as set forth in claim 1 wherein the receiving box includes a reject box and a depositing box.

3. A machine as set forth in claim 2, further comprising a second switching gate means disposed between the third delivery passage and the receiving box for switching the notes from the third delivery passage into either one of the reject box or the depositing box.

4. A machine as set forth in claim 1, further comprising fourth delivery passages for delivering the notes to be paid to the common delivery passage.

* * * * *